US010281219B2

(12) United States Patent
Mizushita et al.

(10) Patent No.: US 10,281,219 B2
(45) Date of Patent: May 7, 2019

(54) PLATE LAMINATED TYPE HEAT EXCHANGER

(71) Applicant: MITSUBISHI HEAVY INDUSTRIES COMPRESSOR CORPORATION, Tokyo (JP)

(72) Inventors: Koichi Mizushita, Hiroshima (JP); Sung-hee Hong, Busan (KR); Hyeon-jun Kim, Busan (KR)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 40 days.

(21) Appl. No.: 15/514,714

(22) PCT Filed: Oct. 1, 2014

(86) PCT No.: PCT/JP2014/076867
§ 371 (c)(1),
(2) Date: Mar. 27, 2017

(87) PCT Pub. No.: WO2016/051608
PCT Pub. Date: Apr. 7, 2016

(65) Prior Publication Data
US 2017/0234622 A1 Aug. 17, 2017

(51) Int. Cl.
*F28D 9/00* (2006.01)
*F28F 3/08* (2006.01)

(52) U.S. Cl.
CPC ..... *F28D 9/0037* (2013.01); *F28F 3/08* (2013.01); *F28F 2250/102* (2013.01); *F28F 2275/04* (2013.01)

(58) Field of Classification Search
CPC . F28D 9/0037; F28D 7/00; F28D 9/00; F28D 1/0308; F28D 9/0006;
(Continued)

(56) References Cited

U.S. PATENT DOCUMENTS 1,662,870 A 3/1928 Stancliffe
3,590,914 A * 7/1971 Duncan ..... F28D 9/0068 165/166
(Continued)

FOREIGN PATENT DOCUMENTS

EP 0 183 007 A1 6/1986
EP 0 212 878 A1 3/1987
(Continued)

OTHER PUBLICATIONS

International Search Report for PCT/JP2014/076867 (PCT/ISA/210) dated Jul. 23, 2015.
(Continued)

*Primary Examiner* — Justin M Jonaitis
(74) *Attorney, Agent, or Firm* — Birch, Stewart, Kolasch & Birch, LLP

(57) ABSTRACT

A plate laminated type heat exchanger includes: a plate laminated body which is formed by laminating a plurality of plates; and a heat exchanger body which includes a first header through which fluid (G) flows in from outside of the plate laminated body and a second header through which the fluid (G) flows out to the outside of the plate laminated body which are connected to the plate laminated body. Each of the plurality of plates is formed from a flat plate shape having a first surface and a second surface. The first surface is provided with a plurality of grooves defined by inner walls through which the fluid flows. The plurality of plates are connected each other so that the first surface of one of the plurality of plates is brazed to the second surface of the other one of the plurality of plates.

8 Claims, 6 Drawing Sheets

(58) Field of Classification Search
CPC .... F28D 9/0025; F28D 9/0031; F28D 9/0062; F28D 9/0081; F28F 3/08; F28F 2250/102; F28F 2275/04; F28F 3/005; F28F 3/02; F28F 3/083
USPC ..... 165/166, 164, 165
See application file for complete search history.

(56) References Cited

U.S. PATENT DOCUMENTS

| | | | | | |
|---|---|---|---|---|---|
| 3,669,186 | A * | 6/1972 | Schauls | F28F 9/02 | 165/166 |
| 3,817,324 | A * | 6/1974 | Andersson | F28F 3/046 | 165/167 |
| 4,347,896 | A * | 9/1982 | Rosman | F28D 9/0018 | 165/166 |
| 4,592,414 | A | 6/1986 | Beasley | | |
| 4,665,975 | A | 5/1987 | Johnston | | |
| 4,815,534 | A * | 3/1989 | Fuerschbach | F28D 9/0075 | 165/166 |
| 5,287,918 | A * | 2/1994 | Banks | B21D 53/045 | 165/165 |
| 5,465,785 | A * | 11/1995 | Adderley | F28D 9/0006 | 165/166 |
| 5,915,469 | A * | 6/1999 | Abramzon | B64D 13/00 | 165/134.1 |
| 2001/0054499 | A1 * | 12/2001 | Gerard | F25J 5/002 | 165/166 |
| 2002/0011331 | A1 | 1/2002 | Lehman et al. | | |
| 2007/0136037 | A1 | 6/2007 | Holzl | | |
| 2009/0294105 | A1 | 12/2009 | Sundararajan et al. | | |

FOREIGN PATENT DOCUMENTS

| | | | |
|---|---|---|---|
| EP | 0 292 245 | A1 | 11/1988 |
| JP | 49-37849 | A | 4/1974 |
| JP | 59-9496 | A | 1/1984 |
| JP | 61-62795 | A | 3/1986 |
| JP | 61-259086 | A | 11/1986 |
| JP | 4-227481 | A | 8/1992 |
| JP | 5-93591 | A | 4/1993 |
| JP | 8-105697 | A | 4/1996 |
| JP | 2002-62085 | A | 2/2002 |
| JP | 2005-207725 | A | 8/2005 |
| JP | 2007-163131 | A | 6/2007 |
| JP | 61-62795 | A | 8/2008 |
| JP | 2008-535261 | A | 8/2008 |

OTHER PUBLICATIONS

Written Opinion of the International Searching Authority for PCT/JP2014/076867 (PCT/ISA/237) dated Jul. 23, 2015.

* cited by examiner

PLATE LAMINATED TYPE HEAT EXCHANGER

TECHNICAL FIELD

The present invention relates to a plate laminated type heat exchanger.

BACKGROUND ART

There is a conventional plate laminated type heat exchanger that includes a plurality of waveform plates which are laminated and bonded to each other. Each waveform plate has a plurality of recessed portion as flow channels of fluid on a surface thereof (For example, see Japanese Unexamined Patent Application Publication No. 2002-62085). In addition, there is a conventional plate laminated type heat exchanger formed from flat plates bonded to each other by diffusion bonding (For example, Japanese Unexamined Patent Application Publication No. Sho 61-62795 and Japanese Unexamined Patent Application Publication (Translation of PCT Application) No. 2008-535261).

SUMMARY OF INVENTION

Technical Problem

When the waveform plates are used in the plate laminated type heat exchanger, a rigidity of the plates may not be sufficiently obtained. In addition, when the plates are bonded to each other by brazing, a bonding force between each plate may not be sufficiently obtained. Further, when a bonding portion to be brazed to an adjacent plate is large, a brazing material may not be sufficiently spread all over the bonding portion, that is, a middle portion in the bonding portion may not be covered by the brazing material and the bonding force between each plate may not be sufficiently obtained. Therefore, in the conventional plate laminated type heat exchange, the plates may be sloughed off or damaged when a pressure in the flow channel becomes equal to or higher than 100 bar during operation.

For this reason, in some of the conventional plate laminated type heat exchanger, each plate is bonded to the adjacent plate by diffusion bonding to obtain the sufficient bonding force therebetween. However, a production cost may increase to produce the plate laminated type heat exchanger by using the diffusion bonding.

Solution to Problem

According to a first aspect of the present invention, a plate laminated type heat exchanger including: a plate laminated body which is formed by laminating a plurality of plates; and a heat exchanger body which includes a first header through which fluid flows in from outside of the plate laminated body and a second header through which the fluid flows out to the outside of the plate laminated body which are connected to the plate laminated body. Each of the plurality of plates is formed in a flat plate shape having a first surface and a second surface. The first surface of at least one of the plurality of plates is provided with a plurality of grooves defined by inner walls through which the fluid flows. The plurality of plates are bonded each other by brazing so that the first surface of one of the plurality of plates is brazed to the second surface of the other one of the plurality of plates.

According to this configuration, since the plurality of grooves are formed on the plate formed in the flat plate shape, each plate can obtain a sufficient rigidity compared with using a waveform plate. Accordingly, the plate laminated type heat exchanger can prevent from being damaged even if a pressure inside the plate laminated type heat exchanger becomes high. Therefore, the plate laminated type heat exchanger can be used under a high pressure environment.

Furthermore, since each of the plurality of plates is bonded to each other by brazing, the plate laminated type heat exchanger can be produced at low cost.

According to a second aspect of the present invention, in the plate laminated type heat exchanger according to the first aspect, the plurality of grooves includes at least two groove groups of a first groove group and a second groove group which has a groove width narrower than a groove width of the first groove group.

According to this configuration, the number of the grooves and the inner walls formed in the second groove group increases. Accordingly, since portions of the first surface at which the inner walls are formed are used as bonding portions to be bonded to an adjacent plate, the plurality of plates are more strongly bonded each other as the number of the inner walls formed in the second groove group increases. In addition, since each bonding portion at which the inner walls are formed is narrow, each bonding portion can be sufficiently covered by a brazing material. Therefore, defects in bonding caused by lacking of the brazing material can be prevented from occurring.

Further, when the pressure inside the plate laminated type heat exchanger becomes high, stress applied to each plate is increased and the plurality of plate may be sloughed off by the stress. However, since the groove width of the second groove group is narrow, the stress is distributed to each groove in the second groove group and the stress applied to the plate decreased. Accordingly, the plurality of plates can be prevented from being sloughed off by the stress even if each plate is bonded by the brazing.

As a result, the plate laminated type heat exchanger can be used under a high pressure environment.

According to a third aspect of the present invention, in the plate laminated type heat exchanger according to the first or second aspect, a merging portion is provided between the first groove group and the second groove group, and at least two inner walls are provided at positions with respect to both sides of the second groove group in a direction intersecting with a flow direction of the fluid.

According to this configuration, the fluid flowing from the first groove group can be merged at the merging portion and uniformly separated into the second groove group even if the first groove group is different in width from the second groove group. Accordingly, the fluid can flow smoothly and uniformly in each of the plurality of grooves. As a result, a pressure loss in the plate laminated type heat exchanger can be prevented and efficiency of the heat exchange can be improved.

According to a fourth aspect of the present invention, in the plate laminated type heat exchanger according to the second or third aspect, when the groove width of the second groove group is W, the width W is set to from 2 mm to 4 mm. A thickness of at least one of the plurality of plate is set to less than the width W.

According to this configuration, since the groove width W of the second groove group is set to from 2 mm to 4 mm, the pressure of fluid is further increased in the second groove group. Accordingly, the speed of the heat exchange can be increased and efficiency of the heat exchange can be improved. In addition, according to this configuration, since the thickness of at least on the plate is set to less than the width W, the plate laminated type heat exchanger can be manufactured in compact and in low cost to reduce materials to form the plate.

According to the fifth aspect of the present invention, in the plate laminated type heat exchanger according to any one of the first to fourth aspect, at least one of the plurality of plates includes a bonding portion formed around the plurality of grooves to bond to the second surface of the other one of the plurality of plates, and the bonding portion includes an auxiliary bonding portion.

According to a sixth aspect of the present invention, in the plate laminated type heat exchanger according to the fifth aspect, the auxiliary bonding portion is formed in groove shape.

According to this configuration, since the auxiliary bonding portion is formed in the bonding portion, a flat area in the bonding portion is divided by the auxiliary bonding portion. Therefore, a brazing material can be sufficiently spread all over the flat area in the bonding portion to be brazed without reducing the total area of the flat area in the bonding portion. Accordingly, each of the plurality of plates is capable of bonding with the strong bonding force and the defects of the plate laminated type heat exchanger can be prevented from occurring.

According to the seventh aspect of the present invention, in the plate laminated type heat exchanger according to fifth aspect, when the groove width of the second groove group is W, a distance from a first end of the plate in a direction orthogonal to the second groove group to an outermost groove in the second groove group closer to the first end of the plate is set to 10 times or less than the width W.

According to this configuration, the bonding portion formed around the plurality of grooves can be reduced and an effective area of the second groove group can be sufficiently large. Accordingly, the speed of the heat exchange can be increased and the efficiency of the heat exchange can be improved.

Advantageous Effects of Invention

According to the above-mentioned plate laminated type heat exchanger, the defects can be prevented from occurring even if the plate laminated type heat exchanger is used under the high pressure environment. Further, the production cost of the plate laminated type heat exchanger can be reduced.

DESCRIPTION OF EMBODIMENTS (Configuration of a Plate Laminated Type Heat Exchanger)

Hereinafter, a plate laminated type heat exchanger 1 according to an embodiment of the present invention will be described with reference to the drawings.

Figure 1:
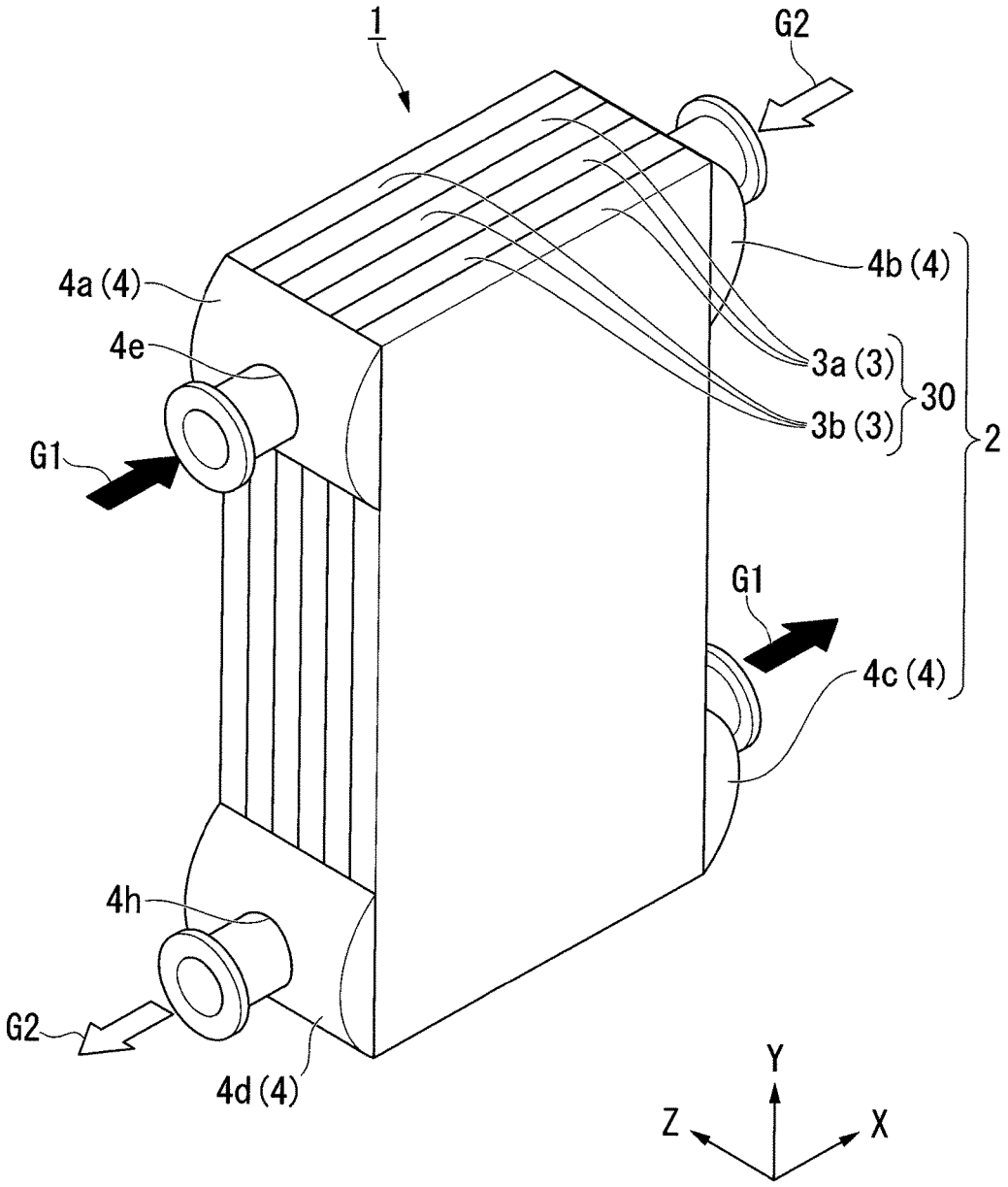
FIG. 1 is a perspective view which shows a plate laminated type heat exchanger according to an embodiment of the present invention.

FIG. 1 is a perspective view which shows a plate laminated type heat exchanger 1.

Figure 2:
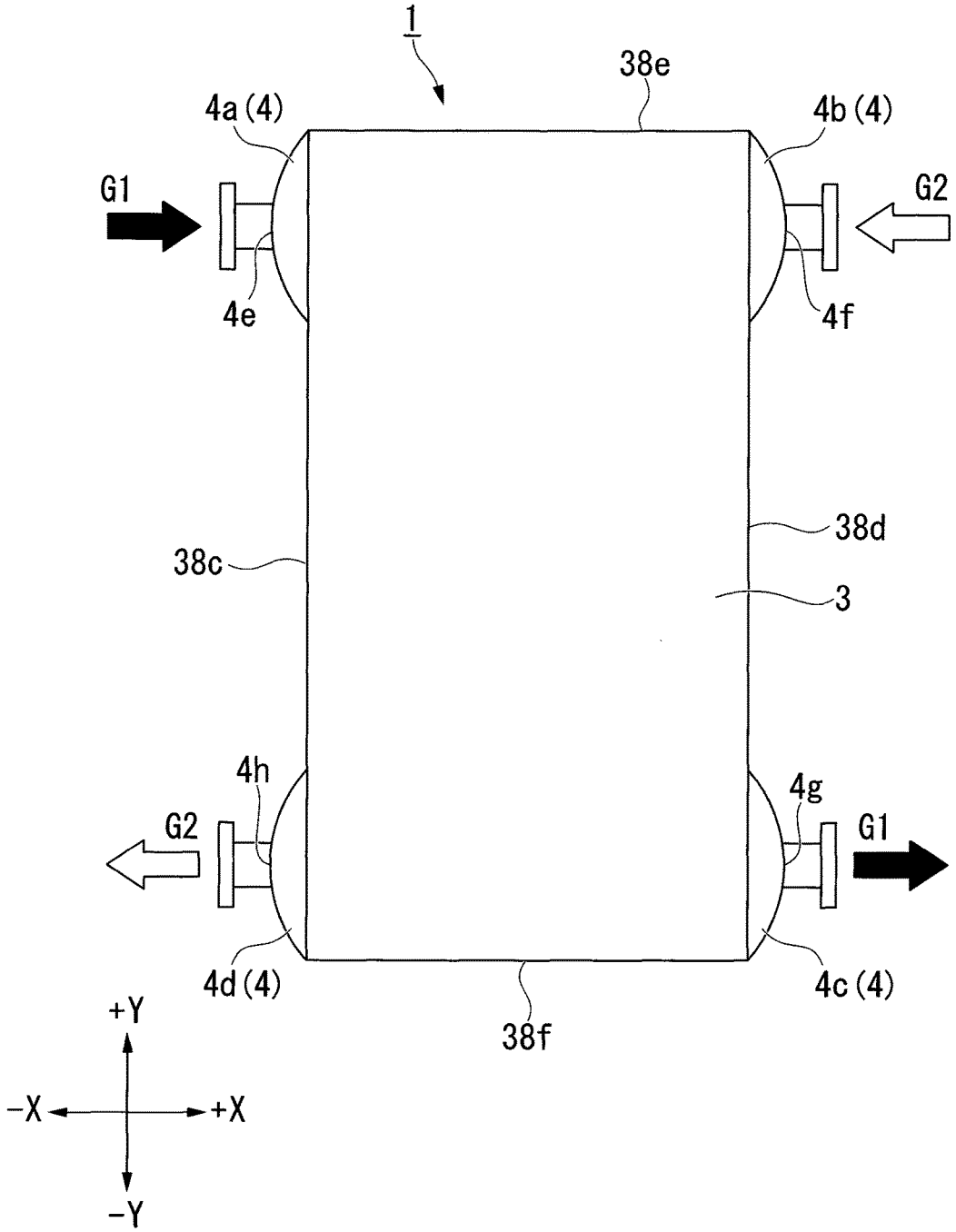
FIG. 2 is a side view which shows the plate laminated type heat exchanger according to the embodiment of the present invention.

FIG. 2 is a side view which shows the plate laminated type heat exchanger 1.

Figure 3:
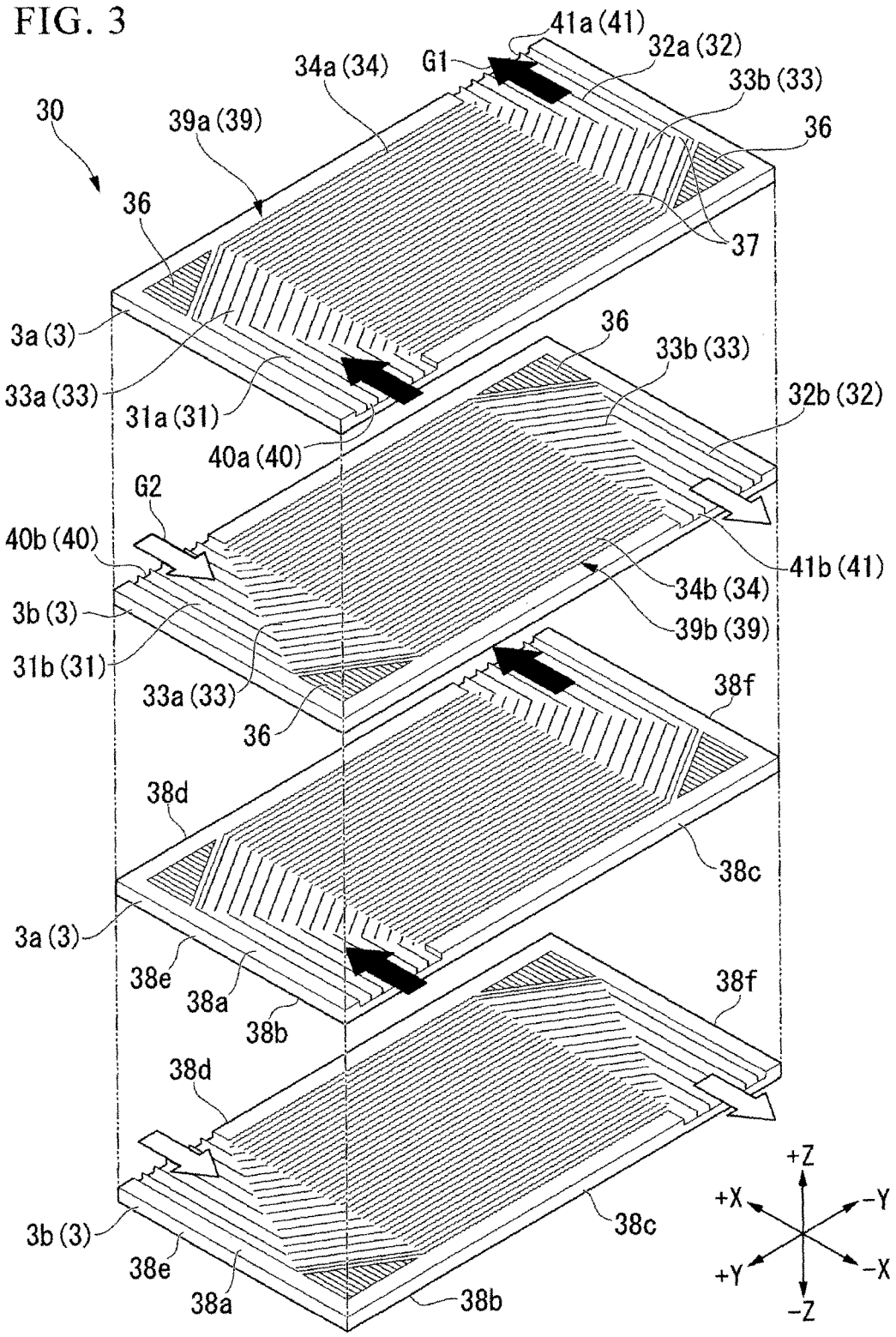
FIG. 3 is an exploded perspective view of a plate laminated body.

FIG. 3 is an exploded perspective view of the plate laminated body 30 according to the embodiment of the present invention.

As shown in FIG. 1, a plate laminated type heat exchanger 1 includes a heat exchanger body 2 which is configured from a plate laminated body 30 and a header 4.

As shown in FIG. 3, the plate laminated body 30 is formed by alternately laminating a first plate 3*a* having a high temperature fluid flow channel 39*a* to flow high temperature fluid G1 and a second plate 3*b* having a low temperature fluid flow channel 39*b* to flow low temperature fluid G2. Hereinafter, the first plate 3*a* and the second plate 3*b* will be collectively referred to as a plate 3. The high temperature fluid flow channel 39*a* and the low temperature fluid flow channel 39*b* will be collectively referred to as a flow channel 39. The high temperature fluid G1 and the low temperature fluid G2 will be collectively referred to as fluid G.

The plate 3 has two directions of a width direction and a longitudinal direction. The width direction corresponds to a direction in which the high temperature fluid G1 flows in and out of the high temperature fluid flow channel 39*a* in FIG. 3.

In the following description, the width direction of the plate 3 is referred to as a X direction. The longitudinal direction of the plate 3 is referred to as a Y direction. A lamination direction of the plate 3 is referred to as a Z direction.

As shown in FIG. 2, the plate 3 has four side surfaces of a first side surface 38*c* which is positioned in one side in the X direction (−X direction), a second side surface 38*d* which is positioned in the other side in the X direction (+X direction), third side surface 38*e* which is positioned in one side in the Y direction (+Y direction), and a fourth side surface 38*f* in the other side in the Y direction (−Y direction).

Four side surfaces of the plate laminated body 30 formed by laminating the plate 3 will be referred to by the same names of the first side surface 38*c*, the second side surface 38*d*, the third side surface 38*e* and the fourth side surface 38*f* of the plate 3.

In this embodiment, as shown in FIG. 2, the header 4 is configured from four headers of a first inlet header 4*a*, second inlet header 4*b*, first outlet header 4*c*, and second outlet header 4*d*.

As shown in FIG. 2, the first inlet header 4*a* is disposed on a first side surface 38*c* of the plate laminated body 30 closer to a third side surface 38*e*. The first inlet header has a first inlet 4*e* through which the high temperature fluid G1 flows in from an outside of the plate laminated body 30.

The second inlet header 4*b* is disposed on a second side surface 38*d* of the plate laminated body 30 closer to the third side surface 38*e*. The second inlet header 4*b* has a second inlet 4*f* through which the low temperature fluid G2 flows in from the outside of the plate laminated body 30.

The first outlet header 4*c* is disposed on a second side surface 38*d* of the plate laminated body 30 closer to a fourth side surface 38*f*. The first outlet header 4*c* has a first outlet 4*g* through which the high temperature fluid G1 flows out to the outside of the plate laminated body 30.

The second outlet header 4*d* is disposed on the first side surface 38*c* of the plate laminated body 30 closer to the fourth side surface 38*f*. The second outlet header 4*d* has a second outlet 4*h* through which the low temperature fluid G2 flows out to the outside of the plate laminated body 30.

As shown in FIG. 3, the plate 3 is formed in a flat plate shape and having a first surface 38*a* and a second surface 38*b*.

As shown in FIG. 3, the high temperature fluid flow channel 39*a*, through which the high temperature fluid G1 flows, is formed in a groove shape on a first surface 38*a* of the first plate 3*a* by etching. The low temperature fluid flow channel 39*b*, through which the low temperature fluid G2 flows, is formed in a groove shape on a first surface 38*a* of the second plate 3*b* by etching.

Figure 4:
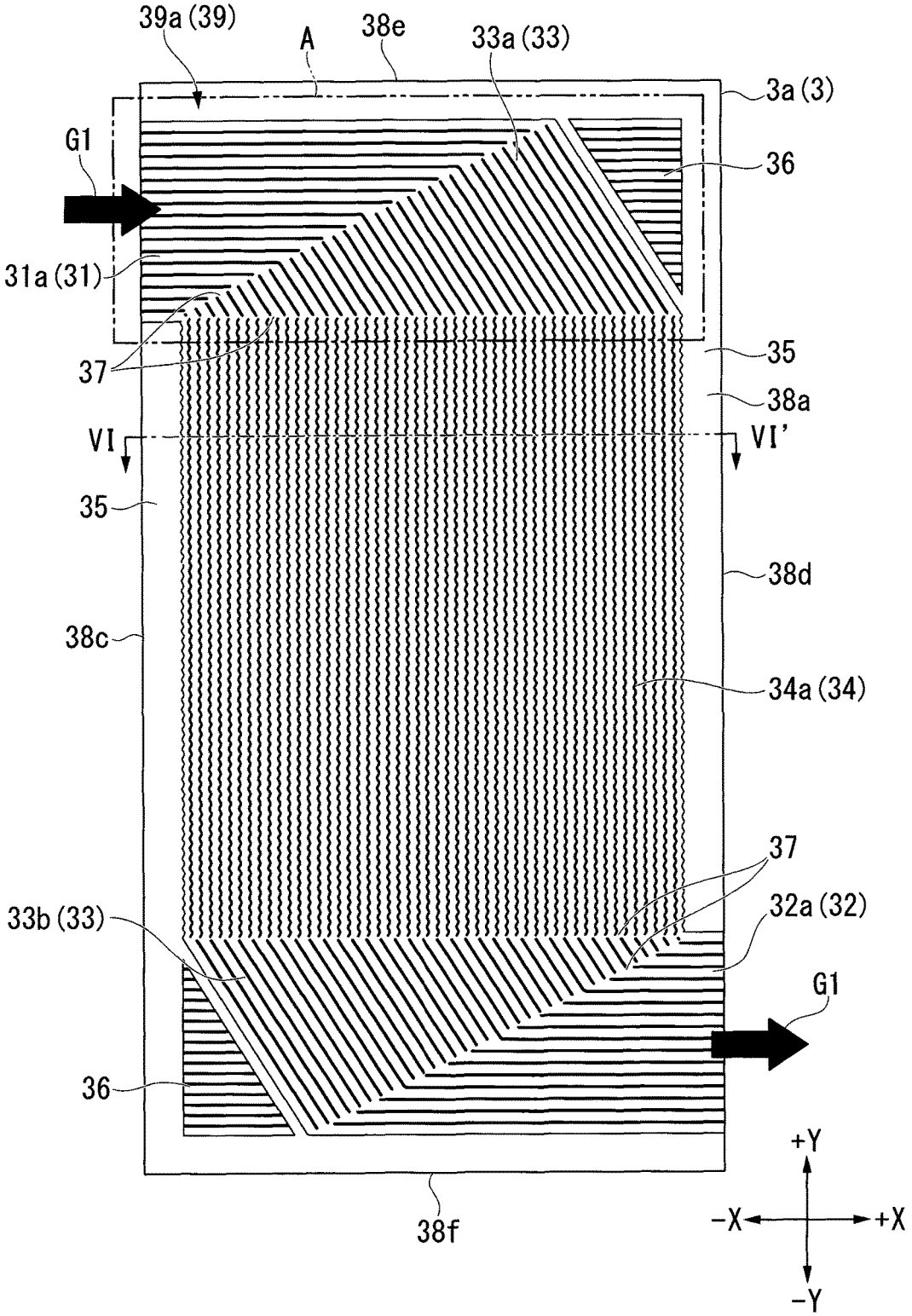
FIG. 4 is a top view which shows a pattern of a flow channel formed on a plate according to the embodiment of the present invention.

FIG. 4 is a top view which shows a pattern of a high temperature fluid flow channel 39*a* formed on the first surface 38*a* of the first plate 3*a* (plate 3).

Figure 5:
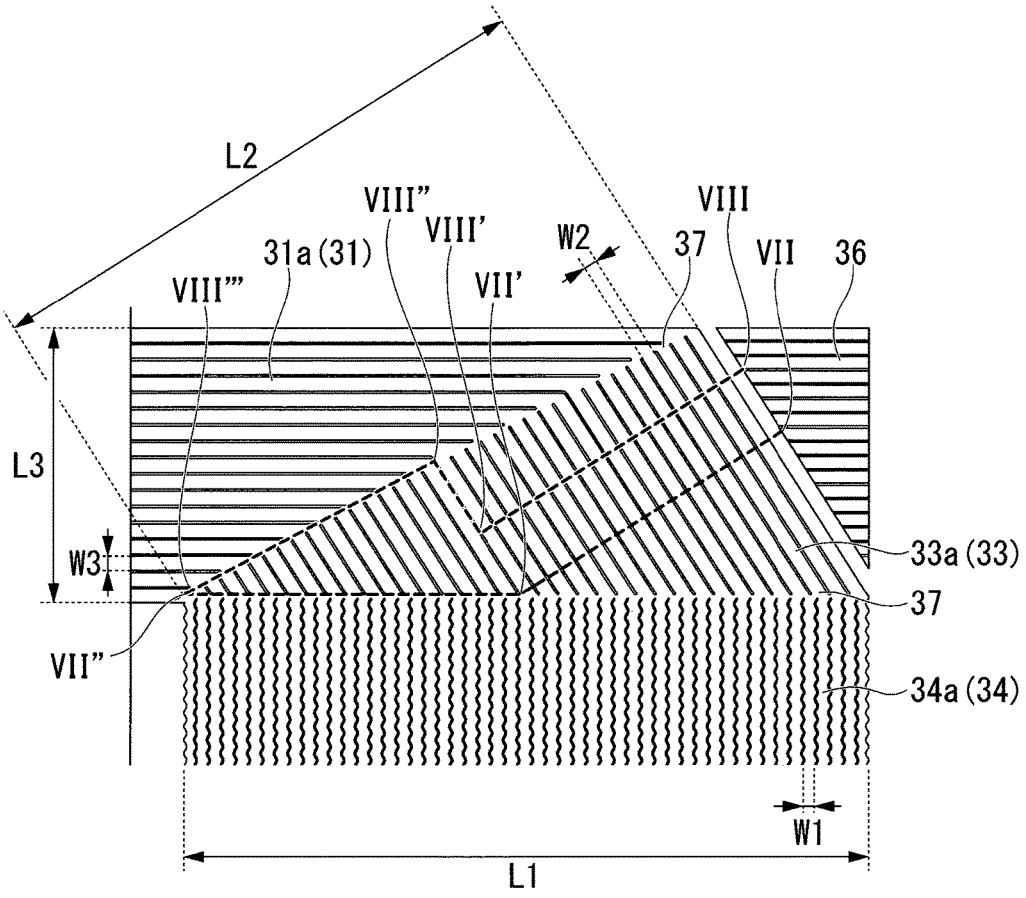
FIG. 5 is an enlarged view of a portion A of FIG. 4.

FIG. 5 is an enlarged view of a portion A of FIG. 4.

Figure 6:
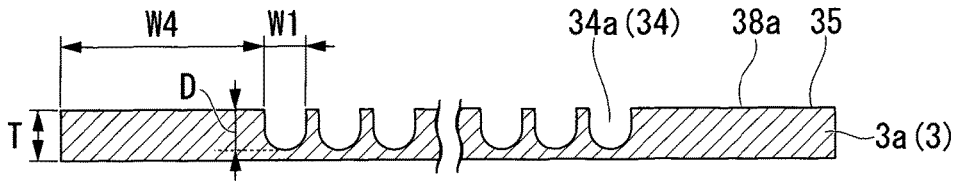
FIG. 6 is a cross-sectional view taken along line VI-VI' of FIG. 4.

FIG. 6 is a cross-sectional view taken along line VI-VI' of FIG. 4.

As shown in FIGS. 3 and 4, the high temperature fluid flow channel 39*a* have four portions of a first inlet channel 31*a*, a first intermediate channel 33*a*, a main channel 34*a*, a second intermediate channel 33*b* and a first outlet channel 32*a*. The low temperature fluid flow channel 39*b* have four portions of a second inlet channel 31*b*, a first intermediate channel 33*a*, a main channel 34*b*, a second intermediate channel 33*b* and a second outlet channel 32*b*.

The first inlet channel 31*a* and the second inlet channel 31*b* will be collectively referred to as an inlet channel 31. The first intermediate channel 33*a* and the second intermediate channel 33*b* will be collectively referred to as an intermediate channel 33. The a main channel 34*a* and the main channel 34*b* will be collectively referred to as a main channel 34. The first outlet channel 32*a* and the second outlet channel 32*b* will be collectively referred to as an outlet channel 32. In addition, the inlet channel 31, the intermediate channel 33 and the outlet channel will be collectively referred to as a first groove group. The main channel 34 will be referred to as a second groove group.

Since basic configuration is the same, the following description will be given based on the high temperature fluid flow channel 39*a* of the first plate 3*a*.

As shown in FIG. 4, the first inlet channel 31*a* is configured from a plurality of grooves having a linear groove shape in a plan view (viewing from the +Z direction) and formed in a range L3 (shown in FIG. 5) in the Y direction so that the plurality of grooves are aligned in the Y direction.

The first inlet channel 31*a* has a first inlet opening 40*a* opening to the first side surface 38*c* of the first plate 3*a* (to the −X direction) at a position apart from the third side surface 38*e* of the first plate 3*a*.

The first inlet channel 31*a* extends toward the second side surface 38*d* side (toward the +X direction) of the first plate 3*a* in parallel with third side surface 38*e* of the first plate 3*a* to a position having a predetermined distance disposed between the first inlet channel 31*a* and the second side surface 38*d* of the first plate 3*a*.

In addition, the first inlet channel 31*a* is formed such that a length in the X direction becoming shorter as approaching to the fourth side surface 38*f* side of the first plate 3*a*.

As shown in FIG. 4, the first intermediate channel 33*a* is configured from a plurality of grooves having a linear groove shape in the plan view (viewing from the +Z direction).

The first intermediate channel 33*a* is formed in a range L2 (shown in FIG. 5) from an outermost groove of the first intermediate channel 33*a* arranged near the first side surface 38*c* to an outermost groove of the first intermediate channel 33*a* arranged near the second side surface 38*d*, in a range L3 in the Y direction and in a range L1 in the X direction.

The first intermediate channel 33*a* is formed from a portion close to an end part of the first inlet channel 31*a* near the second side surface 38*d* (in the +X direction) interposing a merging portion 37 (to be described later) formed therebetween.

The first intermediate channel 33*a* extends and inclines toward the fourth side surface 38*f* of the first plate 3*a* to a same position in the Y direction as a position of an outermost groove of the first inlet channel 31*a* arranged near the fourth side surface 38*f* (in the −Y direction).

As shown in FIG. 4, the main channel 34*a* is formed of a plurality of grooves having waved shapes in the plan view (viewing from the +Z direction) and formed in a range L1 (shown in FIG. 5) in the X direction so that the plurality of grooves are aligned in the X direction.

The main channel 34*a* is formed from a portion close to an end part of the first intermediate channel 33*a* near the fourth side surface 38*f* (in the −Y direction) interposing the merging portion 37 formed therebetween, while an outermost groove of the main channel 34*a* arranged near the first side surface 38*c* (in the −X direction) is connected to an end part close to the second side surface 38*d* (in the +X direction) on the outermost groove of the first inlet channel 31*a* arranged near the fourth side surface 38*f* (in the −Y direction).

The main channel 34*a* is arranged at a substantially center of the first plate 3*a* having predetermined a width W4 (shown in FIG. 6) on both sides of the main channel 34*a* in the X direction.

The main channel 34*a* extends toward the fourth side surface 38*f* (toward the −Y direction) in parallel with the first side surface 38*c* of the first plate 3*a*.

Configuration of the intermediate channel 33*b* is similar to that of the intermediate channel 33*a*. That is, as shown in FIG. 3, the second intermediate channel 33*b* is configured from a plurality of grooves.

The second intermediate channel 33*b* is formed from a portion close to an end part of the main channel 34*a* near the fourth side surface 38*f* (in the −Y direction) interposing the merging portion 37 formed therebetween.

The second intermediate channel 33*b* extends and inclines toward the second side surface 38*d* of the first plate 3*a*.

Configuration of the first outlet channel 32*a* is similar to that of the first inlet channel 31*a*. That is, as shown in FIG. 4, the first outlet channel 32*a* is configured from a plurality of grooves so that the plurality of grooves are aligned in the Y direction.

The first outlet channel 32*a* is formed from a portion close to an end part of the second intermediate channel 33*b* near the second side surface 38*d* (in the +X direction) interposing the merging portion 37 formed therebetween while an outermost groove of the first outlet channel 32*a* arranged near the third side surface 38*e* (in the +Y direction) is connected to an end part close to the fourth side surface 38*f* (in the −Y direction) on an outermost groove of the main channel 34*a* arranged near the second side surface 38*d* (in the +X direction).

The first outlet channel 32*a* extends toward the second side surface 38*d* of the first plate 3*a* (toward the +X direction) in parallel with the fourth side surface 38*f* of the first plate 3*a*.

The first outlet channel 32*a* has a first outlet opening 41*a* opening to the second side surface 38*d* (to the +X direction) of the first plate 3*a* at a position apart from the fourth side surface 38*f* of the first plate 3*a*.

As shown in FIG. 5, the main channel 34*a* has a groove width W1, the first intermediate channel 33*a* has a groove width W2, and the first inlet channel 31*a* has a groove width W3. The second intermediate channel 33*b* has a same groove width as the first intermediate channel 33*a* and the first outlet channel 32*a* has a same groove width as the first inlet channel 31*a*.

The groove width W1 to W3 satisfy following relation:

$$W1<W2<W3$$

In this embodiment, as shown in FIG. 6, the groove width W1 of the main channel 34*a* is set to 2 mm to 4 mm. More preferably, the groove width W1 is set to 3 mm.

A thickness T of the plate 3 is preferably set to less than the width W1. More preferably, the thickness of the plate 3 is set to 2 mm or less.

A groove depth D of the first inlet channel 31*a*, the intermediate channel 33, the main channel 34*a* and the first outlet channel 32*a* is preferably set to approximately 1.5 mm.

Furthermore, the range L1 to L3 satisfy following relation:

$$L3<L2<L1$$

In addition, the number of the grooves in the main channel 34*a* is larger than the intermediate channel 33, and the number of the grooves in the intermediate channel 33 is larger than the first inlet channel 31*a* and the first outlet channel 32*a*.

Figure 7:
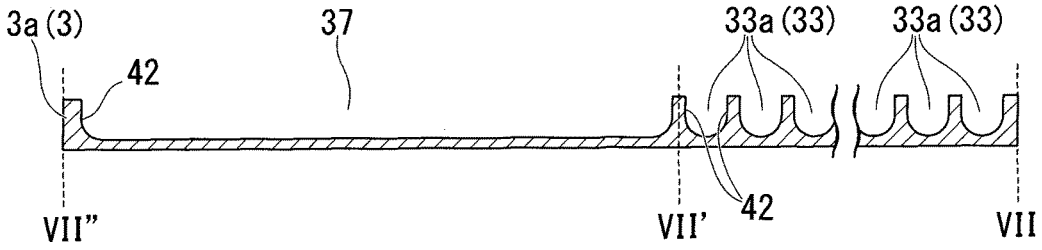
FIG. 7 is a cross-sectional view taken along line VII-VII'-VII" of FIG. 5.

FIG. 7 is a cross-sectional view taken along line VII-VII'-VII" of FIG. 5.

Figure 8:
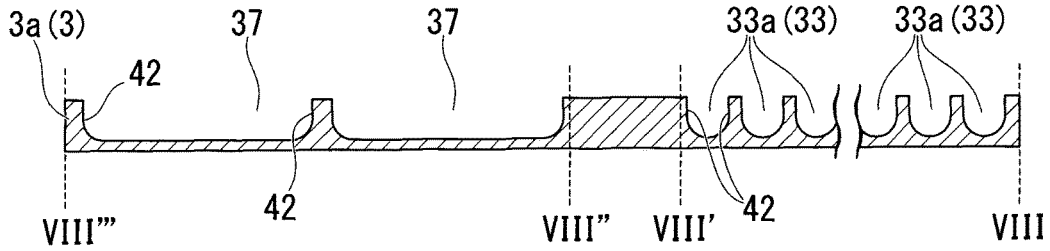
FIG. 8 is a cross-sectional view taken along line VIII-VIII'-VIII"-VIII'" of FIG. 5.

FIG. 8 is a cross-sectional view taken along line VIII-VIII'-VIII"-VIII'" of FIG. 5.

In FIG. 7, the first intermediate channel 33*a* is indicated by a region between VII-VII', and the merging portion 37 is indicated by a region between VII'-VII".

As shown in FIG. 7, the merging portion 37 between the first intermediate channel 33*a* and the main channel 34*a*, for example, is configured to have one groove having a groove width wider than that of the first intermediate channel 33*a*.

More specifically, the first intermediate channel 33*a* is provided with the plurality of grooves defined by inner walls 42 at an interval of the width W2, as shown in the region between VII-VII' in FIG. 7. Accordingly, the high temperature fluid G1 separately flows in each groove in the first intermediate channel 33*a*.

However, the merging portion 37 between the first intermediate channel 33*a* and the main channel 34*a* has two inner walls 42 provided at both sides of the range L1 in the X direction, as shown in the region between VII'-VII" in FIG. 7. One of two inner walls 42 of the merging portion 37 is a portion at which the outermost grooves of the first intermediate channel 33*a* and the main channel 34*a* arranged near the first side surface 38*c* are connected. The other of two inner walls 42 of merging portion 37 is a portion at which the outermost grooves of the first intermediate channel 33*a* and the main channel 34*a* arranged near the second side surface 38*d* are connected. Accordingly, the high temperature fluid G1 flowing from the first intermediate channel 33*a* is merged at the merging portion.

In FIG. 8, the first intermediate channel 33*a* is indicated by a region between VIII-VIII'-VIII", and the merging portion 37 is indicated by a region between VIII"-VIII'".

As shown in FIG. 8, the merging portion 37 between the first inlet channel 31*a* and the first intermediate channel 33*a*, for example, is configured to have a plurality of grooves.

More specifically, the merging portion 37 between the first inlet channel 31*a* and the first intermediate channel 33*a* provided with the plurality of grooves defined by the inner walls 42 at an interval wider than the width W2 of intermediate channel 33 including two inner walls 42 provided at both sides of the range L2, as shown in the region between VIII"-VIII'" in FIG. 8. With this configuration, the high temperature fluid G1 flowing from the first inlet channel 31*a* can still be merged at the merging portion 37.

In this embodiment, two type of the merging portion 37, a first type in which the merging portion 37 having one groove and a second type in which the merging portion 37 having the plurality of grooves, are described. However, the merging portion 37 between the first intermediate channel 33*a* and the main channel 34*a* may be formed in the second type. The merging portion 37 between the first inlet channel 31*a* and the first intermediate channel 33*a* may be formed in the first type.

The merging portion 37 between the main channel 34*a* and the second intermediate channel 33*b*, and between the second intermediate channel 33*b* and the first outlet channel 32*a* are also formed in any one of the first type and the second type.

As shown in FIG. 4, a bonding portion 35 is formed around the high temperature fluid flow channel 39*a* of the first plate 3*a* which is configured to bond to the second surface 38*b* of the second plate 3*b* to form the plate laminated body 30.

As shown in FIG. 6, the bonding portion 35 has the width W4 in the X direction from an end edge of the first surface 38*a* closer to the first side surface 38*c* to the outermost groove of the main channel 34*a* near the first side surface 38*c*.

In this embodiment, the width W4 is preferably set to 10 times or less of the width W1 of the main channel 34*a*.

A shown in FIG. 4, the bonding portion 35 has an auxiliary bonding portion 36 formed at two positions at a side the first intermediate channel 33*a* in the +X direction with a predetermined space and at a side of the second intermediate channel 33*b* in the −X direction with a predetermined space.

In this embodiment, the auxiliary bonding portion 36 formed at the side of the first intermediate channel 33*a*, for example, has a right triangle shape having a first side arranged on a same position in the X direction as a position of the outermost groove of the first inlet channel 31*a* arranged near the third side surface 38*e*, a second side arranged on a same position in the Y direction as a position of the outermost groove of the main channel 34*a* arranged near the second side surface 38*d*, and third side parallel to an outermost groove of the first intermediate channel 33*a* arranged near the second side surface 38*d* interposing a predetermined space therebetween.

A plurality of grooves are formed inside the auxiliary bonding portion 36. In this embodiment, the plurality of grooves of the auxiliary bonding portion 36 are formed at a predetermined interval so that the plurality of grooves extend in the X direction. The plurality of grooves of the auxiliary bonding portion 36 may formed to extend to the other direction, for example, in the Y direction, or the like.

In this embodiment, the low temperature fluid flow channel 39*b* of the second plate 3*b* has a similar shape to the high temperature fluid flow channel 39*a* of the first plate 3*a*. However, the low temperature fluid flow channel 39*b* is formed to have a laterally reversed shape of the high temperature fluid flow channel 39*a* in the X direction.

The following description will be given of only differences between the low temperature fluid flow channel 39*b* of the second plate 3*b* and the high temperature fluid flow channel 39*a* of the first plate 3*a*.

As shown in FIG. 3, a second inlet channel 31*b* has a second inlet opening 40*b* opening to the second side surface 38*d* of the second plate 3*b* (to the +X direction) at a position apart from the third side surface 38*e* of the second plate 3*b*. The second inlet channel 31*b* extends toward the first side surface 38*c* side (toward the −X direction) of the second plate 3*b* in parallel with the third side surface 38*e* of the second plate 3*b* to a position having a predetermined distance disposed between the second inlet channel 31*b* and the first side surface 38*c* of the second plate 3*b*.

As shown in FIG. 3, a first intermediate channel 33*a* is formed from a portion close to an end part of the second inlet channel 31*b* near the first side surface 38*c* (in the −X direction) interposing a merging portion 37 formed therebetween.

The first intermediate channel 33*a* extends and inclines toward the fourth side surface 38*f* of the second plate 3*b* to a same position in the Y direction as a position of an outermost groove of the second inlet channel 31*b* arranged near the fourth side surface 38*f* (in the −Y direction).

As shown in FIG. 3, a main channel 34*b* is formed from a portion close to an end part of the first intermediate channel 33*a* near the fourth side surface 38*f* (in the −Y direction) interposing the merging portion 37 formed therebetween, while an outermost groove of the main channel 34*b* arranged near the second side surface 38*d* (in the +X direction) is connected to an end part close to the first side surface 38*c* (in the −X direction) on the outermost groove of the first inlet channel 31*a* arranged near the fourth side surface 38*f* (in the −Y direction).

In this embodiment, the main channel 34*b* is arranged in a same direction to the main channel 34*a* (in the Y direction).

As shown in FIG. 3, a second intermediate channel 33*b* is formed from a portion close to an end part of the main channel 34*b* near the fourth side surface 38*f* (in the −Y direction) interposing the merging portion 37 formed therebetween.

The second intermediate channel 33*b* extends and inclines toward the first side surface 38*c* of the second plate 3*b*.

As shown in FIG. 3, a second outlet channel 32*b* is formed from a portion close to an end part of the second intermediate channel 33*b* near the first side surface 38*c* side (in the −X direction) interposing the merging portion 37 formed therebetween while an outermost groove of the second outlet channel 32*b* arranged near the third side surface 38*e* (in the +Y direction) is connected to an end part close to the fourth side surface 38*f* (in the −Y direction) on an outermost groove of the main channel 34*a* arranged near the first side surface 38*c* (in the −X direction).

The second outlet channel 32*b* extends toward the first side surface 38*c* of the first plate 3*a* (toward the −X direction) in parallel with the fourth side surface 38*f* of the second plate 3*b*.

The second outlet channel 32*b* has a second outlet opening 41*b* opening to the first side surface 38*c* (to the −X direction) of the second plate 3*b* at a position apart from the fourth side surface 38*f* of the second plate 3*b*.

A shown in FIG. 4, a bonding portion 35 of the second plate 3*b* which is configured to bond to the second surface 38*b* of the first plate 3*a* to form the plate laminated body 30. The bonding portion 35 has an auxiliary bonding portion 36 formed at two positions at a side the first intermediate channel 33 in the −X direction and at a side of the second intermediate channel 33*b* in the +X direction.

(Assembly Method of the Plate Laminated Type Heat Exchanger)

Next, an assembly method of the plate laminated type heat exchanger 1 will be described with reference to FIGS. 1 to 3.

First, as shown in FIG. 3, the first plate 3*a* and the second plate 3*b* are alternately arranged so that the first surface 38*a* of the first plate 3*a* and the second plate 3*b* face the same direction (+Z direction in FIG. 3), and the first inlet opening 40*a* is positioned in an opposite side of the second inlet opening 40*b* of the second inlet channel 31*b* formed on the second plate 3*b* in the X direction.

Then, the bonding portion of the first plate 3*a* and the second plate 3*b* are coated by brazing material and are brazed to the second surface 38*b* of the first plate 3*a* and the second plate 3*b* respectively to form the plate laminated body 30.

Next, as shown in FIG. 2, the first inlet header 4*a* is attached on the third side surface 38*e* side of the first side surface 38*c* of the plate laminated body 30 so that the first inlet 4*e* is arranged with respect to the first inlet opening 40*a* of the first inlet channel 31*a*.

The second inlet header 4*b* is attached on the third side surface 38*e* side of the second side surface 38*d* of the plate laminated body 30 so that the second inlet 4*f* is arranged with respect to the second inlet opening 40*b* of the second inlet channel 31*b*.

The first outlet header 4*c* is attached on the fourth side surface 38*f* of the second side surface 38*d* of the plate laminated body 30 so that the first outlet 4*g* is arranged with respect to the first outlet opening 41*a* of the first outlet channel 32*a*.

The second outlet header 4*d* is attached on the fourth side surface 38*f* of the first side surface 38*c* of the plate laminated body 30 so that the second outlet 4*h* is arranged with respect to the second outlet opening 41*b* of the second outlet channel 32*b*.

In this way, the first inlet header 4*a*, the second inlet header 4*b*, the first outlet header 4*c*, and the second outlet header 4*d* are attached to the plate laminated body 30 to form the heat exchanger body 2 (shown in FIG. 1).

After that, pipes (not shown) to supply the high temperature fluid G1 and the low temperature fluid G2 into the heat exchanger body 2 are connected to the first inlet 4*e* and the second inlet 4*f* respectively. In addition, pipes (not shown) which exhaust the high temperature fluid G1 and the low temperature fluid G2 from the heat exchanger body 2 are connected to the first outlet 4*g* and the second outlet 4*h* respectively.

Accordingly, assembly of the plate laminated type heat exchanger 1 is completed.

(Operation of the Plate Laminated Type Heat Exchanger)

Next, operation of the plate laminated type heat exchanger 1 will be described with reference to FIGS. 2 and 3.

First, as shown in FIG. 2, the high temperature fluid G1 is supplied to the first inlet 4*e* of the first inlet header 4*a* from the outside of the heat exchanger body 2.

As shown in FIG. 3, the high temperature fluid G1 flows into the first inlet channel 31*a* of the high temperature fluid flow channel 39*a* through the first inlet opening 40*a* from the first inlet header 4*a*. In the first inlet channel 31*a*, the high temperature fluid G1 flows in the +X direction along an extending direction of the first inlet channel 31*a*.

Then, the high temperature fluid G1 flows into the merging portion 37 from the first inlet channel 31*a*. The high temperature fluid G1 flown from the first inlet channel 31*a* is merged at the merging portion 37. After that, the high temperature fluid G1 is separated to flow into the first intermediate channel 33*a*.

In the first intermediate channel 33*a*, the high temperature fluid G1 flows in a direction along an inclination of the first intermediate channel 33*a*.

Then, the high temperature fluid G1 flows into the merging portion 37 from the first intermediate channel 33*a*. The high temperature fluid G1 flown from the first intermediate channel 33*a* is merged at the merging portion 37. After that, the high temperature fluid G1 is separated to flow into the main channel 34*a*.

In the main channel 34*a*, the high temperature fluid G1 in the −Y direction along an extending direction of the main channel 34*a*.

Then, the high temperature fluid G1 flows into the merging portion 37 from the main channel 34*a*. The high temperature fluid G1 flown from the main channel 34*a* is merged at the merging portion 37. After that, the high temperature fluid G1 is separated to flow into the second intermediate channel 33*b*.

In the second intermediate channel 33*b*, the high temperature fluid G1 flows in a direction along an inclination of the second intermediate channel 33*b*.

Then, the high temperature fluid G1 flows into the merging portion 37 from the second intermediate channel 33*b*. The high temperature fluid G1 flown from the second intermediate channel 33*b* is merged at the merging portion 37. After that, the high temperature fluid G1 is separated to flow into the first outlet channel 32*a*.

In the first outlet channel 32*a*, the high temperature fluid G1 in the +X direction along an extending direction of the first outlet channel 32*a*. The high temperature fluid G1 flows from the first outlet channel 32*a* to the first outlet header 4*c* through the first outlet opening 41*a*.

Then, as shown in FIG. 2, the high temperature fluid G1 is exhausted to the outside of the heat exchanger body 2 through the first outlet 4*g* of the first outlet header 4*c*.

Furthermore, as shown in FIG. 2, the low temperature fluid G2 is supplied to the second inlet 4*f* of the second inlet header 4*b* from the outside of the heat exchanger body 2.

As shown in FIG. 3, the low temperature fluid G2 flows into the second inlet channel 31*b* of the low temperature fluid flow channel 39*b* through the second inlet opening 40*b* from the second inlet header 4*b*. In the second inlet channel 31*b*, the low temperature fluid G2 flows in the −X direction along an extending direction of the second inlet channel 31*b*.

Then, the low temperature fluid G2 flows into the merging portion 37 from the second inlet channel 31*b*. The low temperature fluid G2 flown from the second inlet channel 31*b* is merged at the merging portion 37. After that, the low temperature fluid G2 is separated to flow into the first intermediate channel 33*a*.

In the first intermediate channel 33*a*, the low temperature fluid G2 flows in a direction along an inclination of the first intermediate channel 33*a*.

Then, the low temperature fluid G2 flows into the merging portion 37 from the first intermediate channel 33*a*. The low temperature fluid G2 flown from the first intermediate channel 33*a* is merged at the merging portion 37. After that, the low temperature fluid G2 is separated to flow into the main channel 34*b*.

In the main channel 34*b*, the low temperature fluid G2 in the −Y direction along an extending direction of the main channel 34*b*.

Then, the low temperature fluid G2 flows into the merging portion 37 from the main channel 34*b*. The low temperature fluid G2 flown from the main channel 34*b* is merged at the merging portion 37. After that, the low temperature fluid G2 is separated to flow into the second intermediate channel 33*b*.

In the second intermediate channel 33*b*, the low temperature fluid G2 flows in a direction along an inclination of the second intermediate channel 33*b*.

Then, the low temperature fluid G2 flows into the merging portion 37 from the second intermediate channel 33*b*. The low temperature fluid G2 flown from the second intermediate channel 33*b* is merged at the merging portion 37. After that, the high temperature fluid G1 is separated to flow into the second outlet channel 32*b*.

In the second outlet channel 32*b*, the low temperature fluid G2 in the −X direction along an extending direction of the second outlet channel 32*b*.

The low temperature fluid G2 flows to the second outlet header 4*d* through the second outlet opening 41*b*.

Then, as shown in FIG. 2, the low temperature fluid G2 is exhausted to the outside of the heat exchanger body 2 through the second outlet 4*h* of the second outlet header 4*d*.

In this way, the high temperature fluid G1 flowing through the main channel 34*a* and the low temperature fluid G2 flowing through the main channel 34*b* flow in the same direction (−Y direction in FIG. 3).

At this time, heat of the high temperature fluid G1 is transferred to the low temperature fluid G2 and heat exchange therebetween is performed.

(Effects)

In this way, in the embodiment mentioned above, since the flow channel 39 is formed so that the groove width W1 of the main channel 34, the groove width W2 of the intermediate channel 33 and the groove width W3 of the inlet channel 31 and the outlet channel 32 satisfy the relation W1<W2<W3, the number of the grooves and the inner walls 42 formed in the main channel 34 increases. Since portions of the first surface 38*a* at which the inner walls 42 are formed are used as the bonding portions to be bonded to an adjacent plate 3, the plates 3 are more strongly bonded each other as the number of the inner walls 42 formed in the main channel 34 increases. Moreover, since each bonding portion at which the inner walls 42 are formed is narrow, each bonding portion can be sufficiently covered by a brazing material. Therefore, defects in bonding caused by lacking of the brazing material can be prevented from occurring.

In addition, when the pressure inside the plate laminated type heat exchanger 1 becomes high, stress applied to each plate 3 is increased and the plurality of plates 3 may be sloughed off by the stress. However, since the groove width W1 of the main channel 34 is narrow, the stress is distributed to each groove in the main channel 34 and the stress applied to the plate 3 decreased. Accordingly, the plurality of plates 3 can be prevented from being sloughed off.

As a result, the plate laminated type heat exchanger 1 can be used under a high pressure environment, for example, in which the pressure is higher than 100 bar.

Since bonding force between each plate 3 is increased with the configuration mentioned above, each plate 3 is capable of being bonded each other by brazing even if the plate laminated type heat exchanger 1 is used under the high pressure environment. Further, since each plate 3 is bonded by brazing, the plate laminated type heat exchanger 1 can be produced at low cost.

In addition, since the width W1 of the main channel 34 is set to 2 mm to 4 mm, the pressure of fluid G is further increased in the main channel 34, the speed of the heat exchange between the high temperature fluid G1 and the low temperature fluid G2 can be increased and efficiency of the heat exchange can be improved.

Further, since the thickness T of the plate 3 is set to less than the width W1 of the main channel 34, a thin plate can be used to form the plate 3. Accordingly, the plate laminated type heat exchanger 1 can be manufactured in compact and in low cost to reduce materials to form the plate 3.

In addition, since the flow channel 39 is formed in a groove shape by etching on the first surface 38*a* of the plate 3 having flat plate shape, the groove width W1 of the main channel 34 is capable of being narrowed and the plate 3 can obtain a sufficient rigidity compared with using a waveform plate although the plate 3 is formed from the thin plate. Accordingly, the plate laminated type heat exchanger 1 can prevent from being damaged even if a pressure inside the plate laminated type heat exchanger 1 becomes higher than 100 bar. Therefore, the plate laminated type heat exchanger 1 can be used under a high pressure environment.

Further, since the flow channel 39 is formed so that the range L1 in which the main channel 34 is formed, the range L2 in which the intermediate channel 33 is formed and the range L3 in which the inlet channel 31 and the outlet channel 32 are formed satisfy the relation L3<L2<L1, an effective area of the main channel 34, in which the heat exchange is performed, can increase while areas of the intermediate channel 33, the inlet channel 31 and the outlet channel 32 decreased. Accordingly, the heat exchange can be effectively performed.

In addition, since the merging portion 37 is formed between the inlet channel 31 and the intermediate channel 33, between the intermediate channel 33 and the main channel 34, between the main channel 34 and the intermediate channel 33 and between the intermediate channel 33 and the outlet channel 32, the fluid G flowing from the inlet channel 31 is merged at the merging portion 37 and uniformly separated into the intermediate channel 33, the fluid G flowing from the intermediate channel 33 is merged at the merging portion 37 and uniformly separated into the main channel 34, the fluid G flowing from the main channel 34 is merged at the merging portion 37 and uniformly separated into intermediate channel 33, and the fluid G flowing from the intermediate channel 33 is merged at the merging portion 37 and uniformly separated into the outlet channel 32.

With the configuration mentioned above, although the number of the grooves formed in the inlet channel 31 and the outlet channel 32, the number of the grooves formed in the intermediate channel 33 and the number of the grooves formed in the main channel 34 are different, the fluid G can be merged at each merging portion 37 and uniformly separated into each channel. Accordingly, the fluid G can flow smoothly and uniformly into each channel of the flow channel 39. As a result, a pressure loss in the plate laminated type heat exchanger 1 can be prevented and efficiency of the heat exchange can be improved.

When a total area of the bonding portion to be brazed is small, a bonding force between each plate may not be sufficiently obtained. In addition, when the bonding portion has a large flat area to be brazed, the brazing material may not be sufficiently spread all over the flat area in the bonding portion and a middle of the flat area in the bonding portion may not be covered by the brazing material. As a result, the bonding force between each plate may be weakened and the defects of the plate laminated type heat exchanger may occur.

However, in the embodiment mentioned above, since the auxiliary bonding portion 36 is formed in the bonding portion 35, the bonding portion 35 becomes large and the flat area in the bonding portion 35 is divided by the auxiliary bonding portion 36. Therefore, the brazing material can be sufficiently spread all over the flat area in the bonding portion 35 to be brazed without reducing the total area of the bonding portion 35. Accordingly, each plate 3 is capable of bonding with the strong bonding force and the defects of the plate laminated type heat exchanger can be prevented from occurring.

Further, since the effective area of the main channel 34, in which the heat exchange is performed, can increase while the areas of the intermediate channel 33, the inlet channel 31 and the outlet channel 32 decreased, as mentioned above, the main channel 34 is capable of having sufficient effective area even if the area of the bonding portion 35 increased to form the auxiliary bonding portion 36.

Although the shape or combination of each component has been illustratively described in the above embodiment, specific configurations are not limited thereto and a design modification may be made appropriately without departing from the principles and spirit of the invention.

Although the configuration that the high temperature fluid G1 flowing through the main channel 34*a* and the low temperature fluid G2 flowing through the main channel 34*b* flow in the same direction (−Y direction in FIG. 3) has been described in the above embodiment, the present invention is not limited thereto.

The high temperature fluid G1 flowing through the main channel 34*a* may flow in a direction opposite to the low temperature fluid G2 flowing through the main channel 34*b*, or in a direction perpendicular to the low temperature fluid G2 flowing through the main channel 34*b*. In this configuration, the heat exchange can be sufficiently performed.

However, in this case, the grooves formed in the high temperature fluid flow channel 39*a* and the low temperature fluid flow channel 39*b* are needed to be appropriately arranged based on the direction to which the high temperature fluid G1 and the low temperature fluid G2 is to be flown.

Although the configuration that the flow channel 39 is formed in the groove shape on the first surface 38*a* of the plate 3 having the flat plate shape by etching has been described in the above embodiment, the present invention is not limited thereto.

The flow channel 39 may be formed in the groove shape by machining.

Although the configuration that the intermediate channel 33, the inlet channel 31 and the outlet channel 32 are formed in the linear groove shape while the main channel 34 is formed in the waved shape has been described in the above embodiment, the present invention is not limited thereto.

The main channel 34 may be formed in the linear groove shape. Since the effective area of the main channel 34 is sufficiently large, the heat exchange can be effectively performed in the main channel 34.

The intermediate channel 33, the inlet channel 31 and the outlet channel 32 may be formed in the waved shape. Accordingly, the heat exchange efficiency can increase at the intermediate channel 33, the inlet channel 31 and the outlet channel 32.

Although the configuration that the auxiliary bonding portion 36 is formed in the right triangle shape has been described in the above embodiment, the present invention is not limited thereto.

The auxiliary bonding portion 36 may be formed in any shape other than the right triangle shape when the flat area in the bonding portion 35 can be divided.

In addition, the auxiliary bonding portion 36 is not limited to have the plurality of grooves. The auxiliary bonding portion 36 may have an emboss pattern or a knurling pattern. The bonding force can be sufficiently obtained with these configurations.

INDUSTRIAL APPLICABILITY

According to the present invention, the defects can be prevented from occurring even if the plate laminated type heat exchanger is used under the high pressure environment. Further, the production cost of the plate laminated type heat exchanger can be reduced.

REFERENCE SIGNS LIST

1 plate laminated type heat exchanger
2 heat exchanger body
3 plate
4 header
4*a* first inlet header (inlet header)
4*b* second inlet header (inlet header)
4*c* first outlet header (outlet header)
4*d* second outlet header (outlet header)
4*e* first inlet (inlet)
4*f* second inlet (inlet)
4*g* first outlet (outlet)
4*h* second outlet (outlet)
30 plate laminated body
3*a* first plate (plate)
3*b* second plate (plate)
31 inlet channel (first groove group)
31*a* first inlet channel (inlet channel)
31*b* second inlet channel (inlet channel)
32 outlet channel (first groove group)
32*a* first outlet channel (outlet channel)
32*b* second outlet channel (outlet channel)
33 intermediate channel (first groove group)
33*a* first intermediate channel (intermediate channel)
33*b* second intermediate channel (intermediate channel)
34 main channel (second groove group)
35 bonding portion
36 auxiliary bonding portion
37 merging portion
38*a* first surface
38*b* second surface
38*c* first side surface
38*d* second side surface
38*e* third side surface
38*f* fourth side surface
39 flow channel
39*a* high temperature fluid flow channel (flow channel)
39*b* low temperature fluid flow channel (flow channel)
40 inlet opening
40*a* first inlet opening
40*b* second inlet opening
41 outlet opening
41*a* first outlet opening
41*b* second outlet opening
42 inner wall
G fluid
G1 high temperature fluid
G2 low temperature fluid
W1, W2, W3 groove width
W4 width of the bonding portion
T plate thickness
D groove depth
L1, L2, L3 range in which the flow channel is formed

CITATION LIST

Patent Literature

[PTL 1]
Japanese Unexamined Patent Application Publication No. 2002-62085
[PTL 2]
Japanese Unexamined Patent Application Publication No. Sho 61-62795
[PTL 3]
Japanese Unexamined Patent Application Publication (Translation of PCT Application) No. 2008-535261

The invention claimed is:

1. A plate laminated type heat exchanger comprising:

a plate laminated body which is formed by laminating a plurality of plates; and a heat exchanger body which includes a first header through which fluid flows in from outside of the plate laminated body and a second header through which the fluid flows out to the outside of the plate laminated body which are connected to the plate laminated body, wherein each of the plurality of plates is formed in a flat plate shape having a first surface and a second surface, the first surface of at least one of the plurality of plates is provided with a plurality of grooves defined by inner walls through which the fluid flows, and the plurality of plates is bonded each other by brazing so that the first surface of one of the plurality of plates is brazed to the second surface of the other one of the plurality of plates, the plurality of grooves includes at least two groove groups of a first grove group and a second groove group which has a groove width narrower than a groove width of the first groove group, the first group includes;

an inlet channel which opens to a first side of the plate and extends toward a second side of the plate opposite to the first side along with a width direction of the plate;

an outlet channel which opens to the second side of the plate and extends toward the first side of the plate along the width direction of the plate;

a first intermediate channel which extends toward a direction inclined with respect to the width direction and a longitudinal direction of the plate, and connects the inlet channel and the second groove group; and a second intermediate channel which extends toward a direction inclined with respect to the width direction and the longitudinal direction of the plate, and connects the second groove group and the outlet channel, the second groove group includes a main channel which extends in the longitudinal direction of the plate, at least one of the plurality of plate includes a bonding portion formed around the plurality of grooves to bond to the second surface of the other one of the plurality of plates, and the bonding portion includes auxiliary bonding portions outside the first groove group and the second groove group, the auxiliary bonding portions are provided at the second side of the first intermediate channel and the first side of the second intermediate channel.

2. The plate laminated type heat exchanger according to claim 1, wherein a merging portion is provided between the first groove group and the second groove group, and at least two inner walls are provided at positions with respect to both sides of the second groove group in a direction intersecting with a flow direction of the fluid.

3. The plate laminated type heat exchanger according to claim 2, wherein when the groove width of the second groove group is W, the width W is set to from 2 mm to 4 mm, and a thickness of at least one of the plurality of plate is set to less than the width W.

4. The plate laminated type heat exchanger according to claim 2, wherein at least one of the plurality of plates includes a bonding portion formed around the plurality of grooves to bond to the second surface of the other one of the plurality of plates, and the bonding portion includes an auxiliary bonding portion.

5. The plate laminated type heat exchanger according to claim 1, wherein when a groove width of the second groove group is W, the groove width W is set to from 2 mm to 4 mm, and a thickness of at least one of the plurality of plate is set to less than the width W.

6. The plate laminated type heat exchanger according to claim 5, wherein at least one of the plurality of plates includes a bonding portion formed around the plurality of grooves to bond to the second surface of the other one of the plurality of plates, and the bonding portion includes an auxiliary bonding portion.

7. The plate laminated type heat exchanger according to claim 1,

Wherein the auxiliary bonding portions are formed in groove shape.

8. The plate laminated type heat exchanger according to claim 1, wherein when a groove width of the second groove group is W, a distance from a first end of the plate in a direction orthogonal to the second groove group to an outermost groove in the second groove group closer to the first end of the plate is set to 10 times or less than the groove width W.

* * * * *